US005354401A

United States Patent [19]

Asahi et al.

[11] Patent Number: 5,354,401

[45] Date of Patent: Oct. 11, 1994

[54] IMAGE TRANSFER METHOD FOR CARDS

[75] Inventors: Koichi Asahi, Urawa; Noritaka Egashira, Ichikawa, both of Japan

[73] Assignee: Dai Nippon Insatsu Kabushiki Kaisha, Japan

[21] Appl. No.: 115,260

[22] Filed: Sep. 2, 1993

Related U.S. Application Data

[63] Continuation of Ser. No. 957,056, Oct. 6, 1992, abandoned, which is a continuation of Ser. No. 465,200, Mar. 1, 1990, abandoned.

[30] Foreign Application Priority Data

Jul. 1, 1988 [JP] Japan ..... 63-164239

[51] Int. Cl.[5] ..... B44C 1/165

[52] U.S. Cl. ..... 156/230; 156/240; 8/471; 8/506; 346/106; 428/119; 428/411.1

[58] Field of Search ..... 156/230, 240; 8/471, 8/506; 346/1.1, 106; 428/411.1, 119

[56] References Cited

U.S. PATENT DOCUMENTS 3,900,643 8/1975 Kluge et al. .
4,044,181 8/1977 Edhlund .
4,354,851 10/1982 Hix et al. .
4,645,705 2/1987 Abbott, Jr. ..... 156/240
4,652,337 3/1987 Picone et al. ..... 156/240
4,930,814 6/1990 Nusmeier ..... 156/240

FOREIGN PATENT DOCUMENTS 51-52600 11/1977 Japan .
56-66654 11/1982 Japan .
63-51200 3/1988 Japan .
63-87284 4/1988 Japan .
63-81093 11/1988 Japan .

*Primary Examiner*—Patrick J. Ryan
*Assistant Examiner*—Merrick Dixon
*Attorney, Agent, or Firm*—Parkhurst, Wendel & Rossi

[57] ABSTRACT

The present invention is a method for transferring an image to a card by using a thermal transfer sheet having a separation layer provided on one side of a base layer and an image receiving layer on the separation layer for receiving dyes that move from a dye transfer sheet. This method includes placing the thermal transfer sheet on the card and pressing them between a pair of rubber roller having a hardness of 70° to 90° heated to a temperature of 130° C. to 180° C. under a pressure of 3 to 15 kg/cm$^2$.

5 Claims, 1 Drawing Sheet

IMAGE TRANSFER METHOD FOR CARDS

This is a continuation of application Ser. No. 07/957,056 filed Oct. 6, 1992, now abandoned, which in turn is a continuation application of Ser. No. 07/465,200 filed Mar. 1, 1990, now abandoned.

FIELD OF THE INVENTION

The present invention relates to a method for transferring images onto cards.

BACKGROUND OF THE INVENTION

In recent years, there have been many types of prepaid cards being used and of these many types, those that have various types of patterns and designs have been marketed. Along with the widening use of such prepaid cards, there has been an increasing demand by persons wishing to have cards made with their own individual designs and motifs, and special blank cards are being marketed so that people can make their own designs and motifs on them afterwards.

The general method used in order to have an original motif or pattern on a conventional blank card is to employ direct printing onto the surface of the card.

However, when this method is used, there is a considerable lack of immediacy as well as the fact that the method is not suited to the production of small quantities such as one or two cards, and this means that the cost per card is quite high. Not only this, the printed designs are generally exposed on the surface of the card and so there are problems of them being easily scratched and lacking in resistance to plasticizer.

As a result of considering the problems involved in the conventional method, the inventors considered the photograph-quality images that are now possible due to recent advances in thermal transfer technology using the sublimation transfer method, and concluded that if the sublimation transfer recording method was used to transfer an image drawn beforehand onto a thermal transfer sheet, onto a prepaid card, then it would be possible to manufacture original cards far more inexpensively than by the conventional printing method. However, when a laminating machine is used to press and heat and thereby laminate a thermal transfer sheet and a card so that the image is transferred, the lamination performed by a conventional laminating machine involves temperature and pressure conditions (such as a heating temperature of between 100° C. and 130° C. and a pressure of 0.5 to 3.0 kg/cm$^2$) made it difficult to achieve a transferred image which was clear and without cracking. Moreover, although it is possible to lower the heating temperature to 160° C. (as has been proposed on PCT/JP 87/00228, P66), it is not possible to achieve a precise image by only the adjustment of the transfer temperature.

SUMMARY OF THE INVENTION

With respect to this problem, the inventors concluded that it would be possible to complete the present invention if the hardness of the pair of rubber rollers in the laminating device was limited to a certain range, and if the heating temperature and the pressure of these pressure rollers were also controlled to within certain ranges, and thereby make it possible to achieve clear image transfer to prepaid cards.

The objects of the invention can be achieved by providing a method for transferring an image to a card, comprising the steps of: preparing a thermal transfer sheet comprising a base layer, a separation layer and an image receiving layer for receiving dyes that move from a dye transfer sheet laminated in this order; forming an image by a sublimation transfer recording method on said image receiving layer provided in said thermal transfer sheet; placing said thermal transfer sheet on said card in an overlapping relation; passing the overlapped thermal transfer sheet and said card through a pair of rubber rollers of a laminating machine of a hardness selected in a range of 70° to 90° with the rollers heated in a range of 130° to 180° C. and urged to each other under a pressure of 3 to 15 kg/cm$^2$; and separating at least said base layer out of said separation layer so that said image receiving layer is transfer laminated to said card.

In the method mentioned above, the passing step of said thermal transfer sheet and said card is carried out while the rubber rollers are rotated at a rotating speed selected in a range of 0.5 to 1.5 cm/sec.

BRIEF DESCRIPTION OF THE DRAWINGS

In the accompanying drawings indicating an embodiment of the image transfer method for cards, according to the present invention.

DESCRIPTION OF THE PREFERRED EMBODIMENTS

Figure 1:
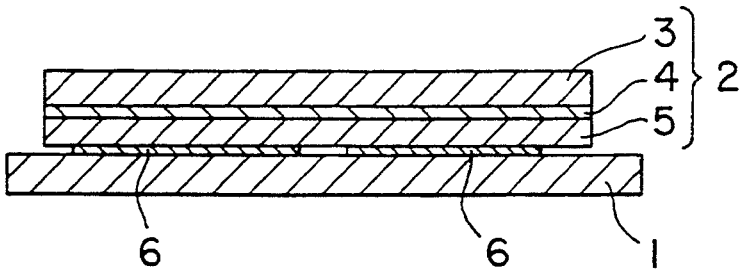
FIG. 1 is a longitudinal sectional view of the status where the thermal transfer sheet and the card are in alignment.

In FIG. 1, reference numeral 1 is a card, and reference numeral 2 is a thermal transfer sheet. The thermal transfer sheet 2 has a base layer 3, a separation layer 4 and an image receiving sheet 5 in order to receive the dye material that moves from a dye transfer sheet (not indicated in the figure). In addition, the image receiving sheet 5 is provided with an image 6 that has been formed by dye material moving from the dye transfer sheet by the sublimation transfer recording method.

After transfer, the base layer 3 is separated from the separation layer 4 and a material such as plastic film, synthetic paper or cellulose fiber paper or the like is used for this base layer 3. Of these substances, the plastic film that is used can be of polyester, PVC, polypropylene, polyethylene, polycarbonate, polyamide or the like. In addition, it is also possible to use foam films that have been slightly foamed and white films that have been manufactured by adding a filler to one of the above types of film.

The synthetic paper that is used can be a mixture of a polyolefin resin or some other type of synthetic resin and an inorganic filler or the like, with this mixture then being extruded, or it can be a polystyrene resin, a polyester resin, a polyolefin resin or some other film surface which has had waterproof pigment applied. The cellulose fiber paper that is used can be Kent paper, coating paper, cast-coated paper, synthetic rubber paper or synthetic resin paper or paper that has been impregnated with synthetic resin emulsion, or the like. In addition, it is possible to use a plastic film, cellulose or a fiber paper that has been adhered to a base material. In this case, the base material can be cellulose paper to which a foamed layer has been adhered to both sides.

The separation layer 4 can be formed by coating the base layer 3 with an acrylic resin, an urethane resin, a vinylchloride-vinylacetate resin, an acetyl cellulose, a silicon resin or some other type of transparent resin. This separation layer 4 covers the image receiving sheet 5 after the base layer 3 has been separated, and functions as a protective layer. Wax or effectively transparent organic or inorganic particles can be added to the separation layer 4. By the addition of this additive, it is possible to improve the scratch resistance of the separation layer 4. In addition, it is also possible to include in the separation layer 4 a photo-stabilizer that absorbs ultraviolet light.

The image receiving sheet 5 contains dyes that move from the dye transfer sheet when the image is formed, and is made of a resin that can receive the dyes and thus form an image. Examples of such resins are the following synthetic resins used individually, or as a mixture of two or more.

(a) Those having ester bonds

Polyester resins (other than those which are phenyl modified), polyacrylate ester resins, polycarbonate resins, polyvinyl acetate resins, styrene acrylate resins, vinyltoluene acrylate resins and the like.

(b) Those having urethane-bonds

Polyurethane resins and the like (c) Those having amide-bonds

Polyamide resins (such as nylon) and the like (d) Those having urea-bonds

Urea resins and the like (e) Those having other bonds of high polarities

Polycaprolactam resins, polystyrene resins, polyvinyl chloride resins, polyacrylonitrile resins and the like.

In addition to the resins listed above, a mixture comprising a saturated polyester and a copolymer of vinyl chloride and vinylacetate may also be used as a resin to form the image receiving layer. The vinylchloride content of the-copolymer is desirably selected from a range of up to 85 to 97 wt %, and the degree of polymerization is desirably selected from a range of from 200 to 800. In addition to the vinylchloride-vinylacetate copolymer, the vinylchloride-vinylacetate copolymer may contain a vinyl alcohol component, a maleic acid component or the like.

Furthermore, in accordance with necessity, the image receiving sheet 5 may also contain an ultraviolet light absorbing agent, an antioxidant, a plasticizer, a pigment lubricant, and silicon oil or some other separation agent.

Figure 2:
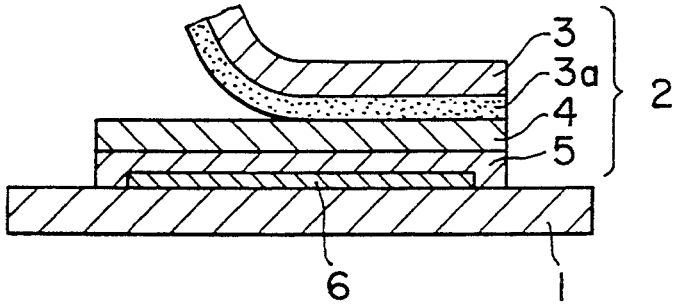
FIG. 2 is a similar view to that of FIG. 1, but where another thermal transfer sheet is used.

Moreover, the thermal transfer sheet 2 is not limited to the one indicated in FIG. 1, and can also be the one indicated in FIG. 2. In FIG. 2, those parts that are the same as those in FIG. 1 are indicated using the same numerals. The thermal transfer sheet 2 of FIG. 2 is provided with an adhesive layer 3*a* on a base layer 3, and on this adhesive layer 3*a* are successively formed a separation layer 4 and an image receiving sheet 5. In addition, the image receiving sheet 5 is provided with an image 6 which is formed by dyes moving from a dye transfer sheet (not indicated in the figure) by the sublimation transfer recording method. Of these layers, the adhesive layer 3*a* can be separated from both the base layer 3 and the separation layer 4.

In FIG. 2, a transparent resin film of 3.0 to 50 μm thickness can be used as the separation layer 4. This transparent film can be a polyethylene terephthalate, a cellulose resin such as cellophane, an acrylic series resin or some other type of transparent vinylchloride film.

In addition, the card 1 to which the image of the thermal transfer sheet 2 is to be transferred to can be a paper card or cellulose base material to which polyethylene terephthalate, a vinylchloride or some other type of plastic card has been press-coated to form a paper-plastic card. There are no particular restrictions however. In addition, the card can also be a magnetic recording card, or a card containing IC chips or the like. Furthermore, it is also possible to use the blank prepaid cards that are marketed.

Figure 3:
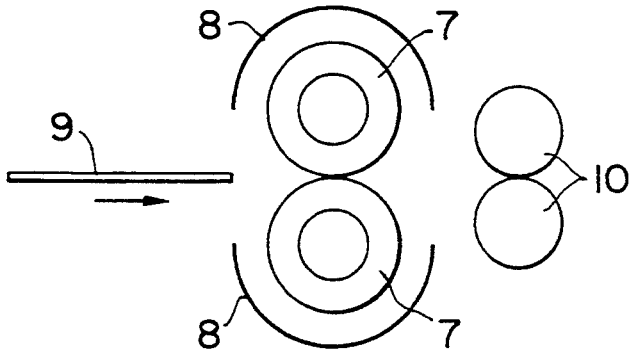
FIG. 3 is an outline sectional view of one of the processes of the present method.

In FIG. 3, reference numeral 7 represents rubber pressing rollers, and reference numeral 8 represents a heater that covers the rubber pressing rollers. Then, the thermal transfer sheet 2 and the card 1 are made to overlap so that the image receiving sheet 5 of the thermal transfer sheet 2 is in contact with the surface of the card 1 and then the overlapping unit 9 is passed between rubber pressing rollers 7, 7 and the overlapping unit 9 is pressed and heated. A heating temperature of between 130° C. and 180° C. is necessary but a heating temperature of between 140° C. and 160° C. is desirable. If the heating temperature is less than 130° C. then there will not be proper transfer of the thermal transfer sheet to the card 1 and if the heating temperature is greater than 180° C. then the card 1 will deform due to the excessive heat. In addition, the pressure of the rubber pressing rollers 7 must be between 3 and 15 kg/cm$^2$ but a pressure of between 10 and 13 kg/cm$^2$ is desirable. If the pressure is less than 3 kg/cm$^2$ then the transfer to the card 1 will not be proper but if the pressure exceeds 15 kg/cm$^2$ then the card 1 will deform and the deformation will also occur in the rubber pressing rollers 7 themselves. Adjusting the pressure of the rubber pressing rollers 7 is enabled by a configuration that varies the interval between the rubber pressing rollers 7, this interval between the rubber pressing rollers 7 (normally the interval between the shafts) can be adjusted to achieve a predetermined pressure but the pressure can also be adjusted by changing the thickness of the rubber or the diameter of the rollers.

The hardness of the rubber of the rubber pressing rollers 7 is 70° to 90° but it is necessary to use rubber with a hardness of between 80° and 85°. Moreover, the rubber hardness is measurable by a rubber penetrometer. If the rubber hardness of the rubber pressing rollers 7 is less than 70° or greater than 90° then it will be difficult to obtain a pressure exceeding 3 kg/cm$^2$. Examples of rubber which has the desired degree of hardness are silicon rubber, ethylene-propylene rubber, styrene-butadiene rubber or the like. In addition, the rubber pressing rollers 7 should rotate at a speed of rotation of between 0.5 and 1.5 cm/sec. and desirably, at a speed of rotation of between 0.8 and 1.2 cm/sec. At such a speed of rotation, it is possible to apply the optimum amount of heat to heat-and-temperature adhere the thermal transfer sheet 2 to the card 1.

After the thermal transfer sheet 2 has been heat-and-temperature adhered to the card 1 in this manner, the base layer 3 is separated from the separation layer 4 (Refer to FIG. 1) or the base layer 3 and the adhesive layer 3*a* are separated from the separation layer 4 (Refer to FIG. 2).

Moreover, in FIG. 3, reference numeral 10 is a pull roller provided according to necessity, and need not be provided.

Figure 4:
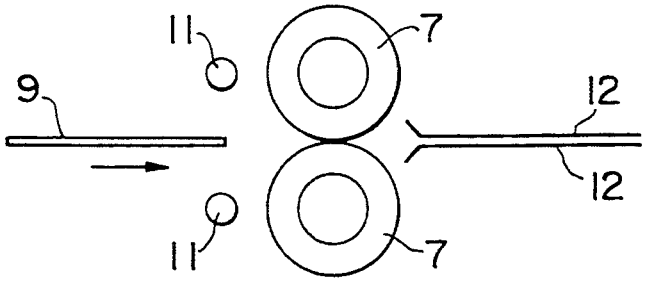
FIG. 4 is an outline sectional view indicating a different state for FIG. 3.

Instead of the heater 8 indicated in FIG. 3, shown in FIG. 4 is a heating method in which a halogen lamp 11 is provided as the means of heating. In addition, reference numeral 12 in FIG. 4 represents a heat-discharge plate which allows efficient cooling of the card 1 if it is provided for a process after the rubber pressing rollers 7.

The following is a more detailed description of the present invention.

EXAMPLE 1

In a laminating machine having two rubber pressing rollers with a rubber hardness of 85°, a rubber thickness of 2 mm and diameters of 28 mm, the two rubber rollers are mounted so that the distance between the shafts of the rubber rollers is 28 mm. When the rubber pressing rollers are mounted in this manner, the rubber roller pressure was measured by a press scale (of FUJI FILM CO.) and was found to be 11.0 kg/cm$^2$. Then, two halogen lamps were placed in the vicinity of these rubber pressing rollers 7 and the temperature of the rubber roller surface was detected by sensors placed in the vicinity of the rubber roller surface. The output of the halogen lamps was controlled by a thermostat so that the temperature of the rubber roller surface was held at approximately 155° C. In addition, the speed of rotation of the rubber rollers was set at 1.0 cm/sec. In this case, the sensor that was used to detect the temperature of the surface was a surface thermometer such as the HL-260 Thermometer (of the ANRITSU KEIKI K.K.).

The base material was formed from foamed polyethylene terephthalate film and one surface was provided with a separation layer of acryl resin, and then an image receiving layer comprising a blended resin blended of polyester and a vinylchloride-vinylacetate copolymer on the surface of a separation layer. Then the HITACHI LTD. VY-S100 dye transfer sheet was used and a videoprinter VY-110 (HITACHI LTD.) was used to form an image on the image receiving layer and then the thermal transfer sheet was made to overlap a prepaid card so that image receiving layer surface was in contact with the surface of the prepaid card. Then, this overlapping unit was passed through a laminating apparatus having the conditions described above, and was heated and pressed by the rubber pressing rollers to be heat-and-pressure bonded. After cooling, the obtained card had a clear photograph-quality image which the image receiving layer being protected by the separation layer. The image of this card could not be removed even by the use of cellophane tape. In addition, there was no deformation of the card or unevenness of transfer, and furthermore, there were no air bubbles (causing lifting of the layer).

OTHER EXAMPLES. 2 THROUGH 21, COMPARATIVE EXAMPLES 1 THROUGH 6

In the same manner as has been described above, a thermal transfer sheet and a prepaid card were used with a laminating apparatus having heating and pressing by rubber pressing rollers with the temperature, rubber hardness and speed of rotation varied as indicated in Table 1, and the same transfer process performed. The states of the cards obtained are indicated in Table 1.

Moreover, the following standards were used for the evaluation of the deformation of the card and the separation test of Table 1.

EVALUATION STANDARDS FOR SEPARATION TEST

○ . . . Difficult to remove image by a separation test using cellophane tape.

Δ . . . Slight separation of image by a separation test using cellophane tape was recognized but this was not sufficient to pose an obstacle to use.

x . . . There was significant removal of the image by a separation test using cellophane tape.

EVALUATION STANDARDS FOR CARD DEFORMATION

○ . . . No deformation

Δ . . . Slight curl but not sufficient to pose an obstacle to use.

x . . . Too much curl to enable use.

TABLE 1

| | Heating temperature (°C.) | Pressing Pressure (kg/cm$^2$) | Rubber hardness (°) | Speed of rotation of rubber rollers (cm/sec.) | State of card: Separation test | State of card: Card deformation | State of card: Transfer state |
|---|---|---|---|---|---|---|---|
| Test example 2 | 145 | 9.0 | 85 | 0.5 | | Δ | Favorable |
| Test example 3 | 145 | 9.0 | 85 | 1.0 | | | Favorable |
| Test example 4 | 145 | 9.0 | 85 | 1.5 | Δ | | Slightly poor adhesion but no problems for use |
| Test example 5 | 145 | 11.0 | 85 | 0.5 | | Δ | Favorable |
| Test example 6 | 145 | 11.0 | 85 | 1.0 | | | Favorable |
| Test example 7 | 145 | 11.0 | 85 | 1.5 | Δ | | Slightly poor adhesion but no problems for use |
| Test example 8 | 145 | 15.0 | 85 | 0.5 | | Δ | Favorable |
| Test example 9 | 145 | 15.0 | 85 | 1.0 | | | Favorable |
| Test example 10 | 145 | 15.0 | 85 | 1.5 | Δ | | Slightly poor adhesion but no problems for use |
| Test example 11 | 155 | 3.0 | 85 | 0.5 | | | Favorable |
| Test example 12 | 155 | 3.0 | 85 | 1.0 | Δ | | Favorable |
| Test example 13 | 155 | 3.0 | 85 | 1.5 | Δ | | Slightly poor adhesion but no problems for use |
| Test example 14 | 155 | 9.0 | 85 | 0.5 | | Δ | Favorable |
| Test example 15 | 155 | 9.0 | 85 | 1.0 | | | Favorable |
| Test example 16 | 155 | 9.0 | 85 | 1.5 | Δ | | Slightly poor adhesion but no problems for use |
| Test example 17 | 155 | 11.0 | 85 | 0.5 | | Δ | Slight transfer unevenness and lifting but no problems for use |
| Test example 18 | 155 | 11.0 | 85 | 1.5 | Δ | | Slightly poor adhesion but no problems for use |
| Test example 19 | 155 | 15.0 | 85 | 0.5 | | Δ | Slight transfer unevenness |

TABLE 1-continued

| | Heating temperature (°C.) | Pressing Pressure (kg/cm²) | Rubber hardness (°) | Speed of rotation of rubber rollers (cm/sec.) | State of card | | |
|---|---|---|---|---|---|---|---|
| | | | | | Separation test | Card deformation | Transfer state |
| | | | | | | | and lifting but no problems for use |
| Test example 20 | 155 | 15.0 | 85 | 1.0 | | | Favorable |
| Test example 21 | 155 | 15.0 | 85 | 1.5 | | | Favorable |
| Comparison example 1 | 120 | 2.0 | 60 | 1.0 | X | | No adhesion |
| Comparison example 2 | 130 | 2.0 | 60 | 1.0 | X | | No adhesion |
| Comparison example 3 | 155 | 2.0 | 60 | 1.0 | X | | Poor adhesion |
| Comparison example 4 | 170 | 2.0 | 60 | 1.0 | | X | Much transfer unevenness and lifting |
| Comparison example 5 | 200 | 2.0 | 85 | 1.0 | | X | Much transfer unevenness and lifting |
| Comparison example 6 | 180 | 2.0 | 60 | 1.0 | | X | Much transfer unevenness and lifting |

As has been described above, according to the method of the present invention, after forming an image on an image receiving layer of a thermal transfer sheet, the image receiving layer is transfer laminated to a card, so that when compared to the method that an image is formed using conventional printing, it is possible to manufacture cards with original designs more promptly and more inexpensively, and the method of present invention is more suitable for the manufacture of small lots such as one or two cards. In addition, the manufacture of cards having a separation layer to protect the image of the card is also simple. Furthermore, according to the method of the present invention, by passing the card and a thermal transfer sheet through a pair of heating and pressing rollers of a laminating machine with a hardness of 70° to 90° while simultaneously heating to a temperature of 130° C. to 180° C. and applying a pressure of 3 to 15 kg/cm² to heat and press the thermal transfer sheet and the card, it is possible to have definite transfer of the image receiving layer of the thermal transfer sheet upon which the image is formed, to the card, and it is also possible to manufacture cards having a clear image which does not separate. Still furthermore, if the lamination is performed with a speed of rotation of the pressure rollers in the laminating apparatus of between 0.5 and 1.5 cm/sec., then it is possible to have sufficient heating to heat-and-press laminate the thermal transfer sheet to the card.

INDUSTRIAL APPLICABILITY

As has been described above, according to the method of the present invention, for the thermal transfer of images to cards, it is possible to have any desired design or motif applied to various types of prepaid card, ID cards and the like.

What is claimed is:

1. A method for transferring an image to a card, comprising the steps of:

preparing a thermal transfer sheet comprising a base layer, a separation layer formed on said base layer and an image receiving layer, for receiving dyes that move from a dye transfer sheet, formed on said separation layer;

forming an image by a sublimation transfer recording method on said image receiving layer;

placing said thermal transfer sheet on said card in an overlapping relation, such that said image receiving layer directly contacts said card;

passing the overlapped thermal transfer sheet and card through a pair of opposed, individually heated rubber rollers of a laminating machine, said rubber rollers having a hardness selected in a range of 70° to 90°, said rubber rollers being heated in a range of 130° C. to 180° C. and being urged against each other under a pressure of 3 to 15 kg/cm²; and separating at least said base layer away from said separation layer so that at least said image receiving layer is transfer laminated to said card.

2. The method of claim 1, wherein said passing step is carried out while said rubber rollers are rotated at a rotating speed selected in a range of 0.5 to 1.5 cm/sec.

3. The method of claim 1, wherein said rubber rollers are heated in a range of 140° C. to 160° C.

4. The method of claim 1, wherein said rubber rollers have a hardness selected in a range of 80° C. to 85° C.

5. The method of claim 2, wherein said rubber rollers are rotated at a rotating speed selected in a range of 0.8 to 1.2 cm/sec.

* * * * *